US008978256B1

(12) United States Patent
Loyer

(10) Patent No.: US 8,978,256 B1
(45) Date of Patent: Mar. 17, 2015

(54) CARPET CUTTING TOOL

(71) Applicant: David H. Loyer, Balsam, NC (US)

(72) Inventor: David H. Loyer, Balsam, NC (US)

( * ) Notice: Subject to any disclaimer, the term of this patent is extended or adjusted under 35 U.S.C. 154(b) by 207 days.

(21) Appl. No.: 13/743,760

(22) Filed: Jan. 17, 2013

(51) Int. Cl.
*B26B 25/00* (2006.01)
*B26B 29/06* (2006.01)

(52) U.S. Cl.
CPC ..... *B26B 29/06* (2013.01)
USPC ..... 30/280; 30/285; 30/294; 30/317

(58) Field of Classification Search
CPC ..... B26B 25/00
USPC ..... 30/280, 282, 285, 289, 290, 294, 314, 30/315, 317
See application file for complete search history.

(56) References Cited

U.S. PATENT DOCUMENTS

| | | | | |
|---|---|---|---|---|
| 1,971,689 | A * | 8/1934 | Mamay | 30/123.7 |
| 2,601,414 | A * | 6/1952 | Mittelstaedt | 30/294 |
| 3,859,725 | A | 1/1975 | Anderson et al. | |
| 4,620,368 | A | 11/1986 | Bowman | |
| 5,242,362 | A * | 9/1993 | Talamantez | 492/13 |
| 5,347,719 | A | 9/1994 | Scharf | |
| 5,387,308 | A | 2/1995 | Heavrin | |
| 5,920,944 | A * | 7/1999 | Biggs et al. | 15/144.4 |
| 6,343,822 | B1 * | 2/2002 | Badura | 294/58 |
| 2001/0029815 | A1 * | 10/2001 | Anderson et al. | 81/490 |
| 2011/0283546 | A1 * | 11/2011 | Abreu et al. | 30/278 |
| 2012/0017450 | A1 * | 1/2012 | Hetts et al. | 30/315 |

* cited by examiner

*Primary Examiner* — Kenneth E. Peterson
*Assistant Examiner* — Nhat Chieu Do
(74) *Attorney, Agent, or Firm* — Crossley Patent Law

(57) ABSTRACT

A carpet cutting tool used from a standing position that has an ergonomic handle member as well as a telescopic auxiliary handle member to guide and support the device and that further has a blade housing body attached to a height adjustable guard plate member which houses a utility blade therein at an angle for cutting carpet.

1 Claim, 6 Drawing Sheets

CARPET CUTTING TOOL

BACKGROUND OF THE INVENTION

Various types of carpet cutting tools are known in the prior art; however, many of these devices have short, non-adjustable handles that require a user to bend down or to crawl on the floor to cut carpet which can expose a user to potentially harmful substances and which can expose the user to physical strain. However, what is needed is a carpet cutting tool that is used from a user's standing position by providing an ergonomic handle member as well as a telescopic auxiliary handle member to guide and support the device and that further has a blade housing body which is attached to a height adjustable guard plate member disposed on a bottom end of a shaft bottom portion. The blade housing body houses a utility blade therein at an angle for cutting carpet.

FIELD OF THE INVENTION

The present invention relates to carpet cutting tools, and more particularly, to a carpet cutting tool used from a standing position that has an ergonomic handle member as well as a telescopic auxiliary handle member to guide and support the device and that further has a blade housing body attached to a height adjustable guard plate member which houses a utility blade therein at an angle for cutting carpet.

SUMMARY OF THE INVENTION

The general purpose of the present carpet cutting tool, described subsequently in greater detail, is to provide a carpet cutting tool which has many novel features that result in a carpet cutting tool which is not anticipated, rendered obvious, suggested, or even implied by prior art, either alone or in combination thereof.

To accomplish this, the present carpet cutting tool includes a handle assembly which, in turn, includes a hollow handle member having a cavity therein to store replacement utility blades, a threaded distal end, a proximal end, and a bottom side. An end cap threadingly is disposed on the distal end. A plurality of ridges is disposed on the bottom side of the handle member to provide an ergonomic grip surface. A cylindrical shaft top portion, having an upper end and a lower end, is disposed on the proximal end of the handle member. A bend is disposed between the upper end of the shaft top portion proximal the proximal end of the handle member and the lower end of the shaft top portion to provide an angle for comfortable use of the device.

An auxiliary handle member telescopically is disposed between the bend and the lower end of the shaft top portion. The auxiliary handle member includes a U-shaped support bracket having a bottom surface and a pair of outer ends. A cylindrical grip member is continuously disposed between the outer ends in a position parallel to the bottom surface. A gap disposed between the grip member and the bottom surface of the support bracket allows a user to securely grip the perimeter of the grip member. An arm of the auxiliary handle member has an inner side centrally disposed on the bottom surface of the support bracket and an outer side having a ring disposed thereon. A pin-lock mechanism selectively interlocks the auxiliary handle member to the lower end of the shaft top portion. The pin-lock mechanism includes an aperture disposed in the ring. A plurality of longitudinally aligned protrusions is disposed on the shaft top portion lower end. One of the protrusions selectively engages the aperture.

A lower cutting portion includes a shaft bottom portion telescopically disposed on the lower end of the shaft top portion. The shaft bottom portion has a top end and a bottom end. A guard plate member, attached to the shaft bottom portion, has a top wall, a bottom wall, a front wall, a rear wall, a right wall, and a left wall. The guard plate member top wall is disposed on the bottom end of the shaft bottom portion. A pair of support frames is longitudinally disposed parallel to each other on the guard plate member bottom wall.

A blade housing body is disposed on the bottom wall of the guard plate member. The blade housing body has a rearwardly directed opening disposed therein. In addition, the blade housing body has an upper wall disposed on the bottom wall of the guard plate, a lower wall disposed opposite the upper wall, a forward wall proximal the front wall of the guard plate member, a partial rearward wall, a right side wall, and a left side wall. An internal wall is disposed between the rearward wall, the lower wall, and the right and left side walls. A notch is disposed on the upper wall between each of the right side wall and the left side wall. Each of the support frames engages one of the notches. The engagement of the support frames and notches with a plurality of fasteners secures the blade housing body to the guard plate member.

The opening is disposed between the rearward wall, the internal wall, the lower wall, and the right and left side walls. The opening has a back wall disposed between the internal wall, the lower wall, and the forward wall. A slot is longitudinally centrally disposed in each of the lower wall, the internal wall, and the back wall.

In use, a utility blade is inserted and disposed at an angle within the opening with the mounting edge disposed within the slot on each of the internal wall and the back wall and a cutting edge directed toward the rearward wall. The angle of the utility blade within the opening is approximately 135 degrees relative the internal wall. A hole in each of the right and left side walls is configured to align with a respective U-shaped cutout on the mounting edge upon installation of the utility blade into the slots. A fastener engages each of the holes and the respective cutout to secure the utility blade within the slots.

The instant carpet cutting tool device enables a user to cut carpet, carpet padding and tile from a comfortable standing position, thus reducing the potential for physical discomfort such as back strain. In addition, the device minimizes the user's direct exposure to potentially harmful substances, such as germs, sewage, mold, and blood from blood-stained carpet and toxic chemicals, from close contact with carpet and tile that can occur with other carpet cutting tools that require a user to crawl on the floor to cut old, dirty, and wet carpet, padding, and tile.

The present tool can minimize workers' claims by addressing the foregoing health issues, thereby potentially reducing insurance premiums for companies employing such workers. The present device further is time saving due to the ease and convenience of using the device compared to carpet cutting devices requiring a user to constantly get into and out of a position on the floor to cut carpet. Thus has been broadly outlined the more important features of the present carpet cutting tool so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
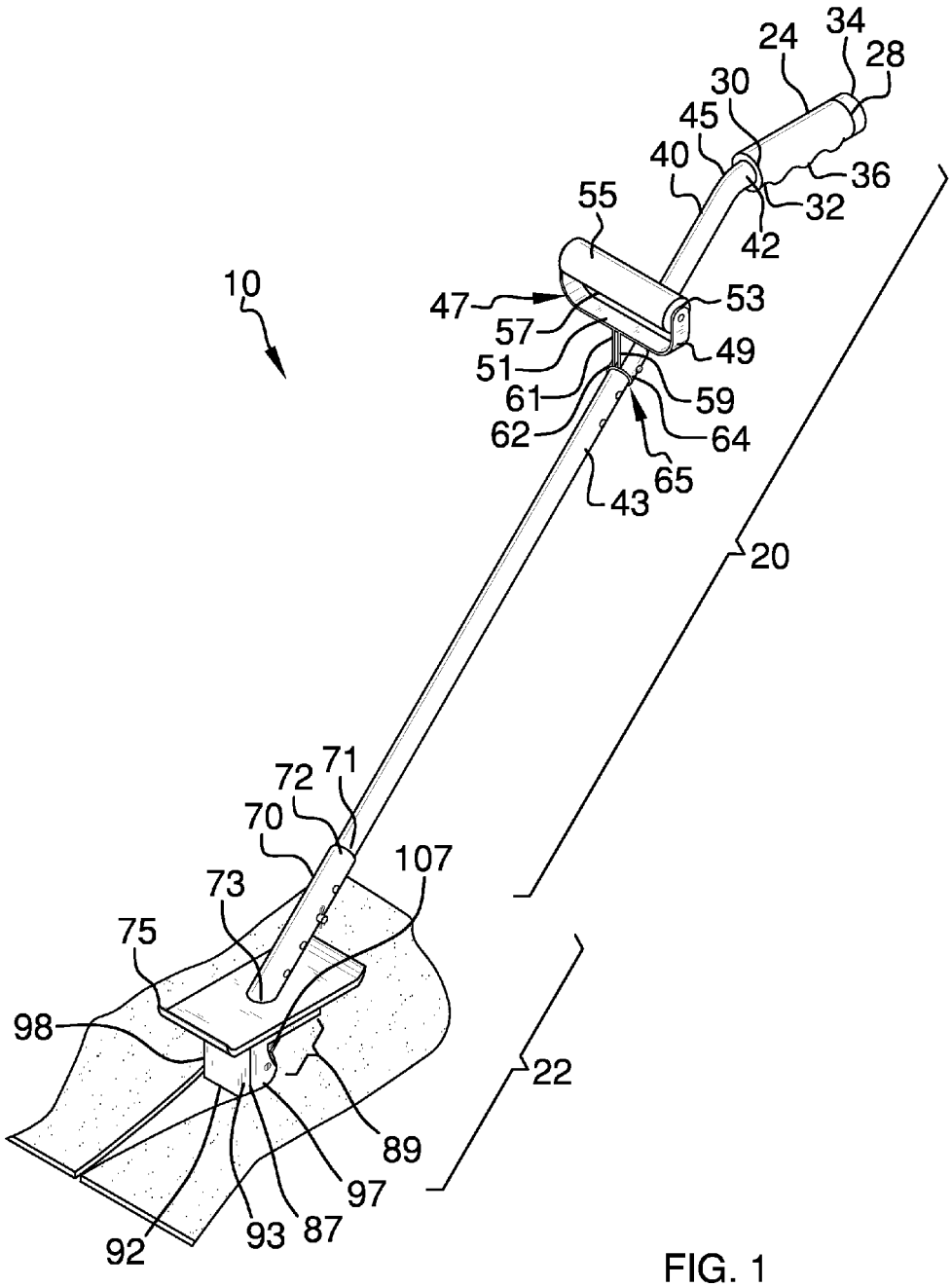
FIG. 1 is an in-use isometric view illustrating use of the device for cutting carpet.
Figure 2:
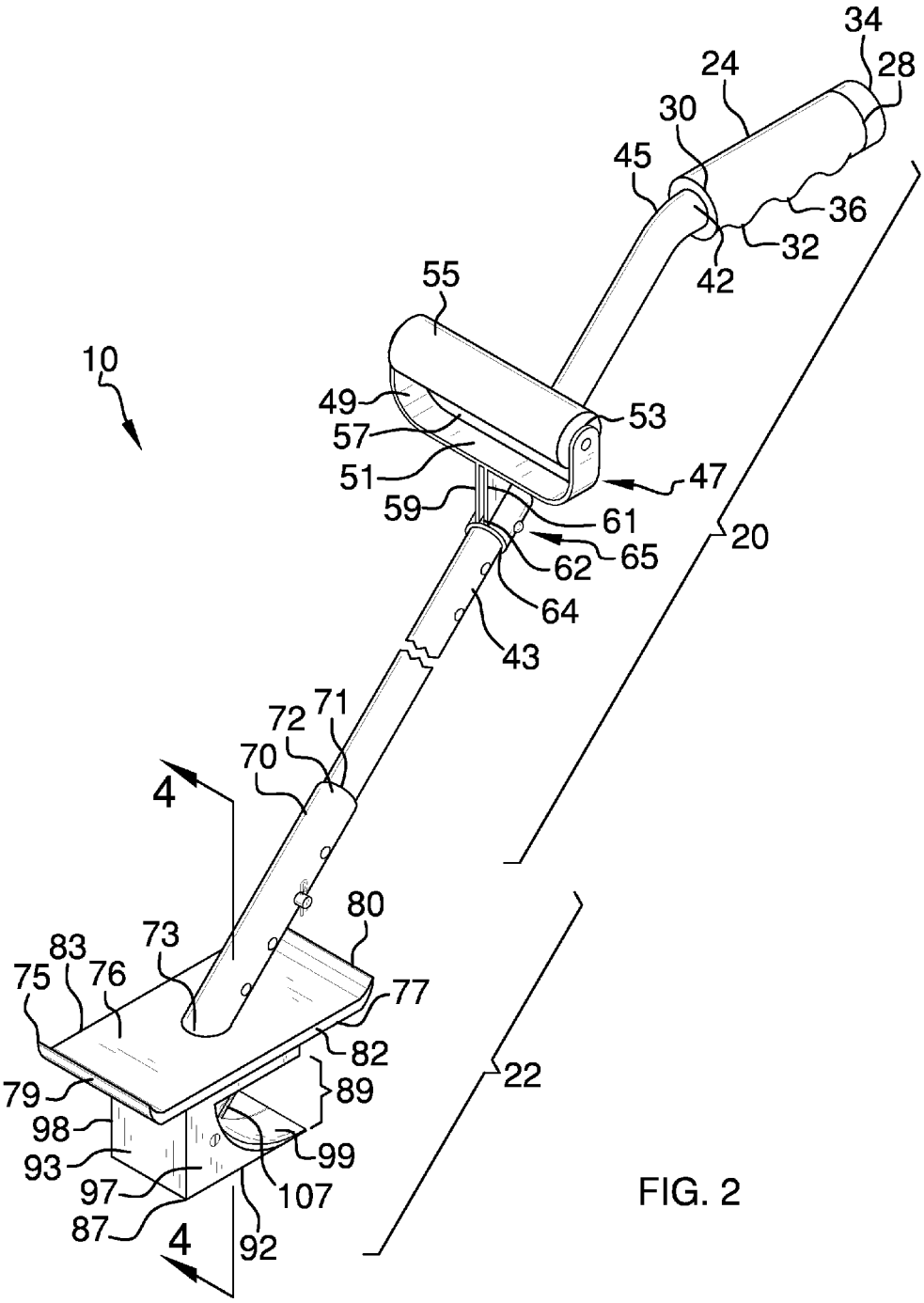
FIG. 2 is an enlarged isometric view.
Figure 3:
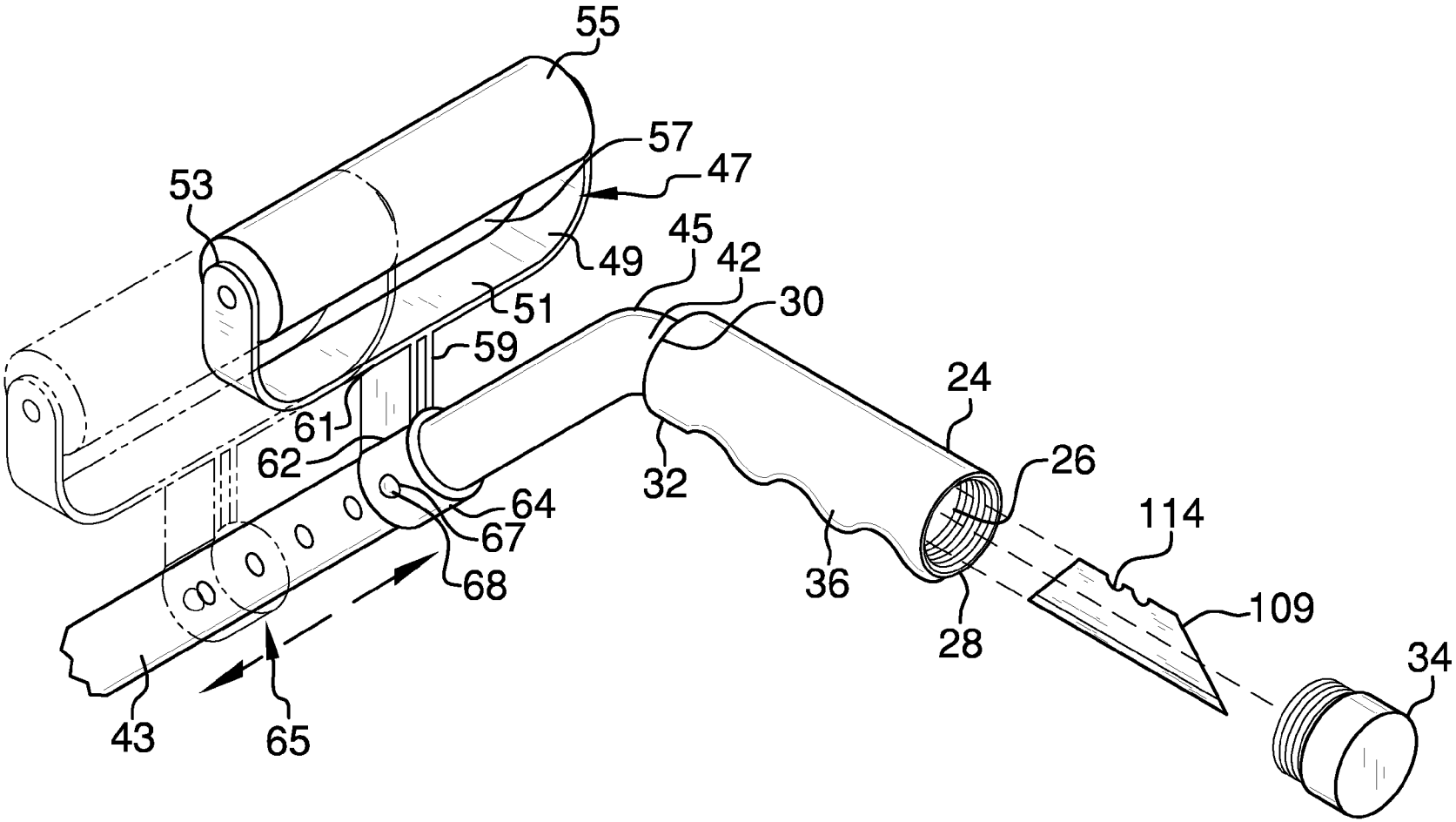
FIG. 3 is an enlarged detail view of a handle assembly.
Figure 4:
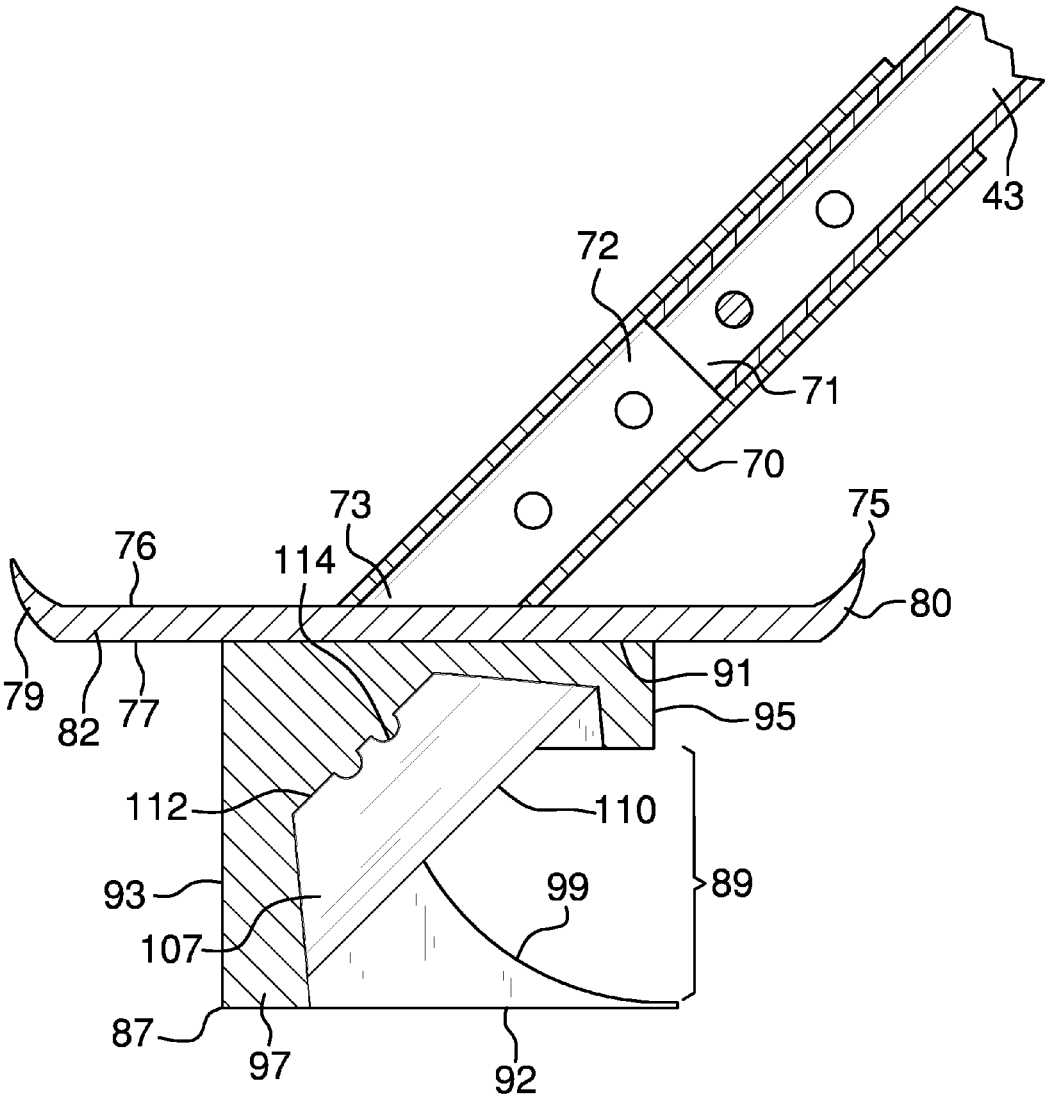
FIG. 4 is a cross-sectional view taken along line 4-4 of FIG. 2.
Figure 5:
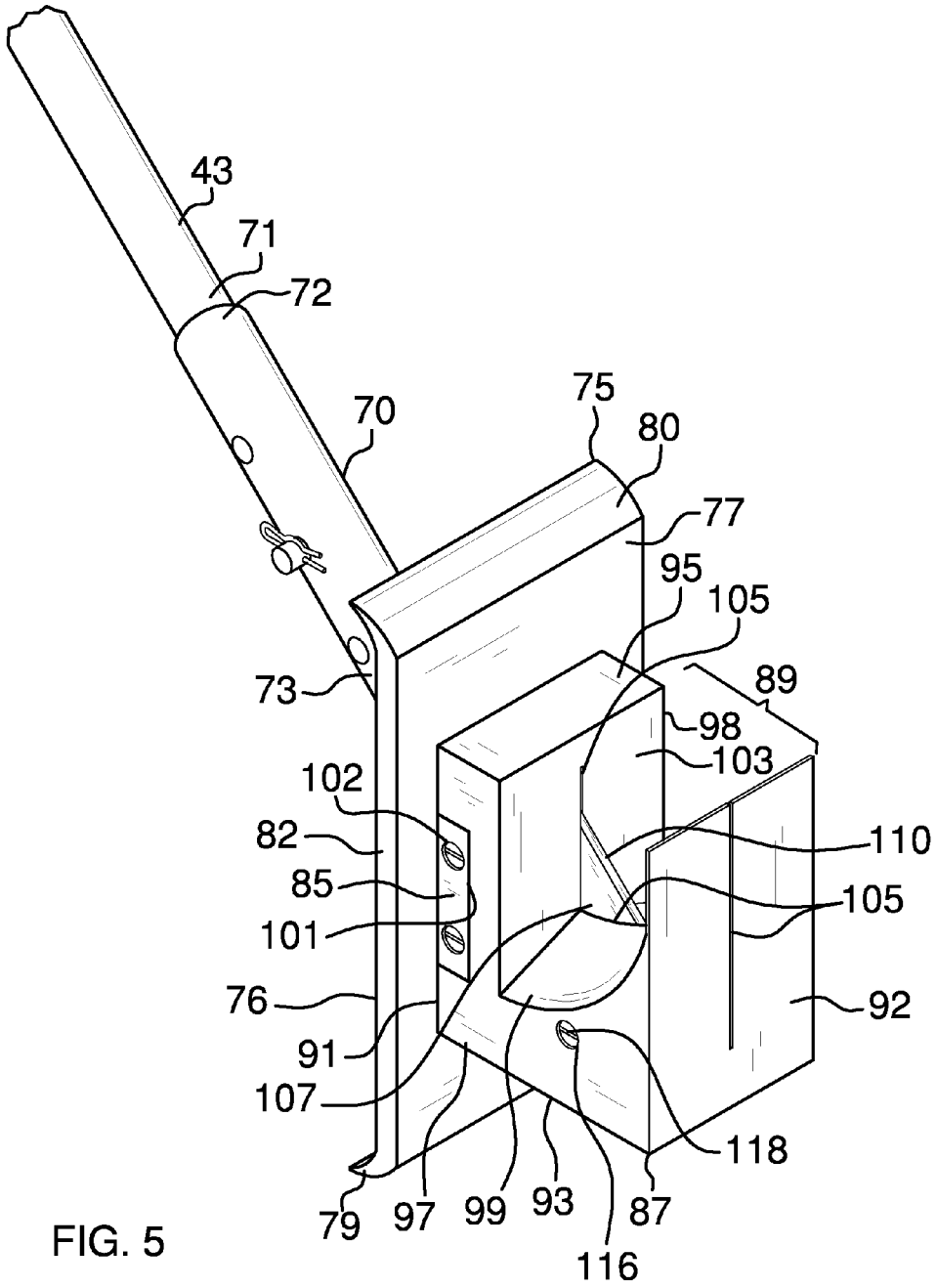
FIG. 5 is a bottom isometric view of lower cutting portion of the device.
Figure 6:
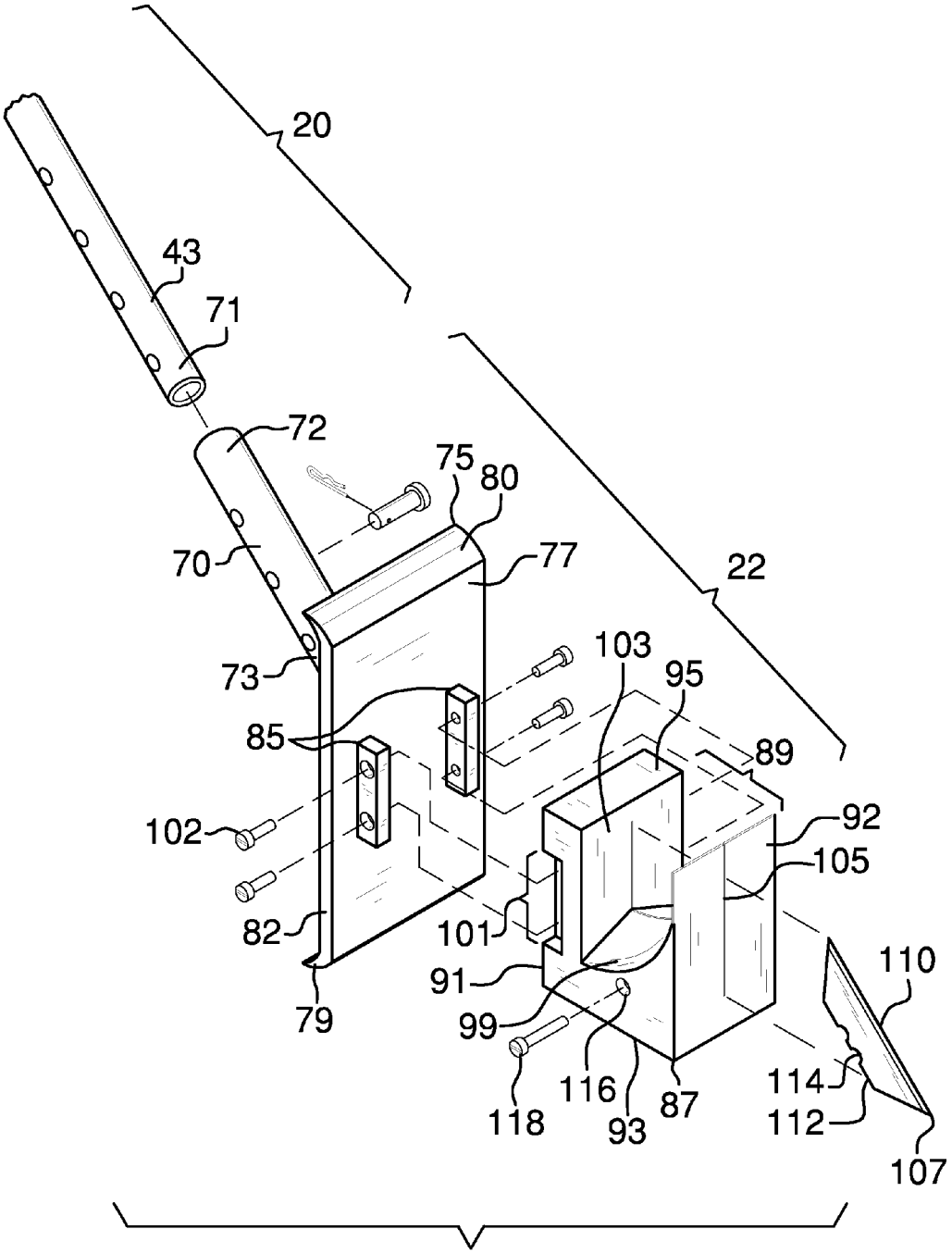
FIG. 6 is an exploded bottom isometric view of the lower cutting portion of the device.

With reference now to the drawings, and in particular FIGS. 1 through 6 thereof, an example of the instant carpet cutting tool employing the principles and concepts of the present carpet cutting tool and generally designated by the reference number 10 will be described.

Referring to FIGS. 1 through 6, the present carpet cutting tool 10 is illustrated. The carpet cutting tool 10 includes a handle assembly 20 and a lower cutting portion 22. The handle assembly 20 includes a hollow handle member 24 having a cavity 26 therein, a threaded distal end 28, a proximal end 30, and a bottom side 32. An end cap 34 threadingly is disposed on the distal end 28. A plurality of ridges 36 is disposed on the bottom side 32 of the handle member 24. The ridges 36 are configured to provide an ergonomic grip surface on the handle member 24. The cavity 26 is configured to store a replacement utility blade 109.

A cylindrical shaft top portion 40 is disposed on the proximal end 30 of the handle member 24. The shaft top portion 40 has an upper end 42 and lower end 43. A bend 45 is disposed between the upper end 42 proximal the proximal end 30 of the handle member 24 and the lower end 43 of the shaft top portion 43.

An auxiliary handle member 47 is telescopically disposed between the bend 45 and the lower end 43 of the shaft top portion 40. The auxiliary handle member 47 includes a U-shaped support bracket 49. The support bracket 49 has a bottom surface 51 and a pair of outer ends 53. A cylindrical grip member 55 is continuously disposed between the outer ends 53 in a position parallel to the bottom surface 51. A gap 57 is disposed between the grip member 55 and the bottom surface 51 of the support bracket 49. An arm 59 of the auxiliary handle member 47 has an inner side 61 and an outer side 62. The inner side 61 is centrally disposed on the bottom surface 51 of the support bracket 49. A ring 64 is disposed on the outer side 62 of the arm 59.

A pin-lock mechanism 65 selectively interlocks the auxiliary handle member 47 to the lower end 43 of the shaft top portion 40. The pin-lock mechanism 65, as detailed in FIG. 3, includes an aperture 67 disposed in the ring 64. A plurality of longitudinally aligned protrusions 68 is disposed on the shaft top portion 40 lower end 43. One of the protrusions 68 selectively engages the aperture 67.

The lower cutting portion 22 of the instant device 10 includes a shaft bottom portion 70 telescopically disposed on the lowermost end 71 of lower end 43 of the shaft top portion 40. The shaft bottom portion 70 has a top end 72 and a bottom end 73. A guard plate member 75 is also included. The guard plate member 75 has a top wall 76, a bottom wall 77, a front wall 79, a rear wall 80, a right wall 82, and a left wall 83. Each of the front wall 77 and the rear wall 80 are upturned. The guard plate member 75 top wall 76 is disposed on the bottom end 73 of the shaft bottom portion 70. A pair of support frames 85 is longitudinally disposed parallel to each other on the guard plate member 75 bottom wall 77.

A blade housing body 87 is disposed on the bottom wall 77 of the guard plate member 75. The blade housing body 87 has a rearwardly directed opening 89 disposed therein. In addition, the blade housing body 87 has an upper wall 91 disposed on the bottom wall 77 of the guard plate member 75, a lower wall 92 disposed opposite the upper wall 91, a forward wall 93 proximal the front wall 79 of the guard plate member 75, a partial rearward wall 95, a right side wall 97, a left side wall 98. An internal wall 99 is disposed between the rearward wall 95, the lower wall 92, and the right and left side walls 97, 98. A notch 101 is disposed on the upper wall 91 between each of the right side wall 97 and the left side wall 98. Each of the support frames 85 engages one of the notches 101. The engagement of the support frames 85 and notches 101 with a plurality of fasteners 102 secures the blade housing body 87 to the guard plate member 75.

The opening 89 is disposed between the rearward wall 95, the internal wall 99, the lower wall 92, and the right and left side walls 97, 98. The opening 89 has a back wall 103 disposed between the internal wall 99, the lower wall 92, and the forward wall 93. A slot 105 is longitudinally centrally disposed in each of the lower wall 92, the internal wall 99, and the back wall 103.

In use, a utility blade 107, which does not constitute an element of the instant device 10, is disposed at an angle within the opening 89. The utility blade 107 has a cutting edge 110 directed toward the rearward wall 95. The utility blade 107 also has a mounting edge 112 disposed within the slot 105 on each of the internal wall 99 and the back wall 103. The angle of the utility blade 107 within the opening is approximately 135 degrees relative the internal wall 99. A hole 116 is disposed in each of the right and left side walls 97, 98. The holes 116 are configured to align with a pair of cutouts 114 disposed on the mounting edge 112 of the utility blade 107 upon installation of the utility blade 107 into the slots 105. A fastener 118 engages each of the holes 116 and the respective cutout 114 to secure the utility blade 107 within the slots 105.

What is claimed is:

1. A carpet cutting tool comprising:

a handle assembly comprising:

a hollow handle member having a cavity therein, a threaded distal end, a proximal end, and a bottom portion;

an end cap threadingly disposed on the distal end;

a plurality of ridges disposed on a bottom side of the handle member, wherein the ridges are configured to provide an ergonomic grip surface on the handle member;

a cylindrical shaft top portion disposed on the proximal end of the handle member, the shaft top portion having an upper end and a lower end;

a bend disposed between the upper end of the shaft top portion proximal the proximal end of the handle member and the lower end of the shaft top portion;

an auxiliary handle member telescopically disposed between the bend and the lower end of the shaft top portion, wherein the auxiliary handle member comprises:

a U-shaped support bracket of the auxiliary handle member, the support bracket having a bottom surface and a pair of outer ends;

a cylindrical grip member continuously disposed between the outer ends in a position parallel to the bottom surface;

a gap disposed between the grip member and the bottom surface of the support bracket;

an arm having an inner side and an outer side, the inner side centrally disposed on the bottom surface of the support bracket; and a ring disposed on the outer side of the arm;

a pin-lock mechanism selectively interlocking the auxiliary handle member to the lower end of the shaft top portion, wherein the pin-lock mechanism comprises:

an aperture disposed in the ring;

a plurality of longitudinally aligned protrusions disposed on the shaft top portion lower end;

wherein one of the protrusions selectively engages the aperture;

a lower cutting portion comprising:

a shaft bottom portion telescopically disposed on a lowermost end of the lower end of the shaft top portion, the shaft bottom portion having a top end and a bottom end;

a guard plate member having a top wall, a bottom wall, a front wall, a rear wall, a right wall, and a left wall, the guard plate member top wall disposed on the bottom end of the shaft bottom portion;

a pair of support frames longitudinally disposed parallel to each other on the guard plate member bottom wall;

a blade housing body disposed on the bottom wall of the guard plate member, the blade housing body having a rearwardly directed opening disposed therein, the blade housing body further having an upper wall disposed on the bottom wall of the guard plate member, a lower wall disposed opposite the upper wall, a forward wall proximal the front wall of the guard plate member, a partial rearward wall, a right side wall, a left side wall, and an internal wall disposed between the rearward wall, the lower wall, and the right and left side walls;

a notch disposed on the upper wall between each of the right side wall and the left side wall, wherein each of the support frames engages one of the notches, wherein the engagement of the support frames and notches with a plurality of fasteners secures the blade housing body to the guard plate member;

wherein the opening is disposed between the rearward wall, the internal wall, the lower wall, and the right and left side walls, the opening having a back wall disposed between the internal wall, the lower wall, and the forward wall;

a slot longitudinally centrally disposed in each of the lower wall, the internal wall, and the back wall;

wherein the opening is configured to receive a utility blade therein at an angle, the utility blade having a cutting edge directed toward the rearward wall;

wherein the slot on each of the internal wall and the back wall is configured to secure a mounting edge of the utility blade therein;

a hole disposed in each of the right and left side walls, wherein the holes are configured to align with a pair of cutouts disposed on the mounting edge upon installation of the utility blade into the slots, wherein a fastener engages each of the holes and the respective cutout, wherein the engagement of the fastener with each of the holes and the respective cutout secures the utility blade within the slots.

* * * * *